US008070018B2

(12) United States Patent
Strecker et al.

(10) Patent No.: US 8,070,018 B2
(45) Date of Patent: Dec. 6, 2011

(54) VISCOELASTIC LIQUID FLOW SPLITTER AND METHODS

(75) Inventors: Timothy D. Strecker, Corvallis, OR (US); Mark W Woodruff, Corvallis, OR (US); Carlos Garcia, Corvallis, OR (US); William S Colburn, San Diego, CA (US); Scott Breidenthal, Carlsbad, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 975 days.

(21) Appl. No.: 11/394,769

(22) Filed: Mar. 31, 2006

(65) Prior Publication Data

US 2007/0235546 A1 Oct. 11, 2007

(51) Int. Cl.
*B67D 7/70* (2010.01)

(52) U.S. Cl. ..... 222/137

(58) Field of Classification Search ..... 222/137, 222/145.1, 145.6, 504, 229, 145.3, 153.04, 222/410–413; 401/120, 204, 143; 239/417; 366/83, 84, 86, 144, 147; 604/191
See application file for complete search history.

(56) References Cited

U.S. PATENT DOCUMENTS

| | | | | |
|---|---|---|---|---|
| 808,635 | A * | 1/1906 | Case | 604/25 |
| 1,948,388 | A * | 2/1934 | Liberson | 604/183 |
| 4,090,640 | A * | 5/1978 | Smith et al. | 222/52 |
| 4,168,942 | A * | 9/1979 | Firth | 425/144 |
| 4,986,443 | A * | 1/1991 | Saur et al. | 222/1 |
| 5,474,540 | A * | 12/1995 | Miller et al. | 604/191 |
| 5,819,988 | A | 10/1998 | Sawhney | |
| 6,286,722 | B1 * | 9/2001 | Fischer et al. | 222/137 |
| 6,613,020 | B1 | 9/2003 | Holm | |
| 6,698,622 | B2 | 3/2004 | Sawhney | |
| 2002/0100770 | A1 * | 8/2002 | Strecker | 222/145.1 |

FOREIGN PATENT DOCUMENTS

WO WO 9531232 5/1995

* cited by examiner

*Primary Examiner* — Kevin P Shaver
*Assistant Examiner* — Robert Nichols, II

(57) ABSTRACT

A viscoelastic liquid flow splitter includes a flow splitter body having a first bore including a first bore outlet and a first bore inlet, and a second bore including a second bore outlet and a second bore inlet. The bore inlets are substantially parallel to each other and the bore outlets diverge from each other at an angle. The flow splitter also includes a compression fitting having a first and a second tubular portion fluidically coupled to the first and second bore inlets where the tubular portions are configured to fluidically couple to a double barreled viscoelastic liquid dispensing syringe.

18 Claims, 10 Drawing Sheets

VISCOELASTIC LIQUID FLOW SPLITTER AND METHODS

BACKGROUND

Description of the Art

The ability to dispense a precise quantity of liquid such as an adhesive, a lubricant, a conductive epoxy, a solder paste, or various other fluids at precise locations on a surface is important to a number of manufacturing processes, especially in the electronics, medical, automotive, and aerospace industries. The assembly of circuit boards, hard disk drives, inkjet cartridges, flat panel displays, cell phones, personal digital assistants, medical devices, sensors, motors, and pumps are just a few examples of manufactured products that utilize such processes. During normal operation, it is desirable to achieve and maintain high repeatability in the dispensing quantity in spite of variations in temperature, viscosity, or both.

For some applications, the liquid dispensed is extremely sensitive to such variations, this is especially true where the dispensed liquid has a relatively high viscosity which itself varies as the temperature changes. This can result in changes in the volume of material dispensed over time. An example of this type of problem is in the encapsulation of integrated circuits where typically a two-part epoxy is premixed by the epoxy manufacturer and frozen. Generally the premixed epoxy is shipped and then stored in this frozen state. When the buyer is ready to utilize the epoxy it is first thawed and then used typically within a few days, and in some instances within several hours. Thus, during normal operation the viscosity will change, both due to temperature variation as well as due to the two components reacting together creating variations in dispensed volume over time. This is true generally for those dispensers which utilize pneumatically actuated time/pressure dispensing mechanisms. In addition, typically, there are also problems relating to the entrapment of air within the liquid to be dispensed because small gas bubbles in the liquid compress, causing sputtering and inaccuracies in the volume of material dispensed.

Current dispenser technology for adhesives that are packaged as two parts (e.g. resin and hardener for two part epoxies) typically utilize static mixing to blend the resin and hardener together and then dispense the mixture directly to the bond line (i.e. onto the surface desired). A static mixer consists of immovable blades in a short cylindrical tube that facilitates dispersive mixing of the two parts as they exit their respective reservoirs. This technology works well for dispense rates in the tens of milliliters to liter per second range. For systems that use a static mixer, the control, typically, utilizes either a motor or pneumatic pressure to push the adhesive through the mixer. Due to the viscoelastic behavior of most adhesives, controlling the dispense rate and dispense end point when dispensing a bead may be difficult. Static mixers can deliver flow rates in the micro-liter per second range, but typically not with the same accuracy as a positive displacement type pump. Generally, the accurate dispensing of viscoelastic fluids is made even more difficult as the distance between the dispense tip and fluid-driving mechanism is increased, such as by utilizing a longer static mixing tube. Even with small static mixer tubes, the lack of proximity of the dispense tip from the fluid-driving mechanism, typically, results in dispense start delays and dripping or oozing at the dispensing end point. As the dispense volumes diminish into the sub-milliliter range these issues become even more critical.

For dispense rates in the micro-liter per second range typically used in electronic, medical, and semiconductor manufacturing, the accuracy of the amount of material dispensed is achieved utilizing positive displacement dispenser technology. Currently, adhesive dispensing utilizing positive displacement pump technology generally uses pre-mixed, degassed, frozen materials such as epoxies that are thawed and then dispensed.

If these problems persist, the continued growth and advancements in the dispensing of a precise quantity of a liquid at precise locations on a surface, which is important in a number of manufacturing processes, will be hindered. In areas like consumer electronics, the demand for cheaper, smaller, more reliable, higher performance devices constantly puts pressure on improving and developing cheaper, faster and more reliable manufacturing processes such as the dispensing of fluids. The ability to optimize the dispensing of materials such as adhesives, lubricants, epoxies, and solder pastes will open up a wide variety of applications that are currently either impractical or are not cost effective.

DESCRIPTION OF THE PREFERRED EMBODIMENTS

Figure 1A:
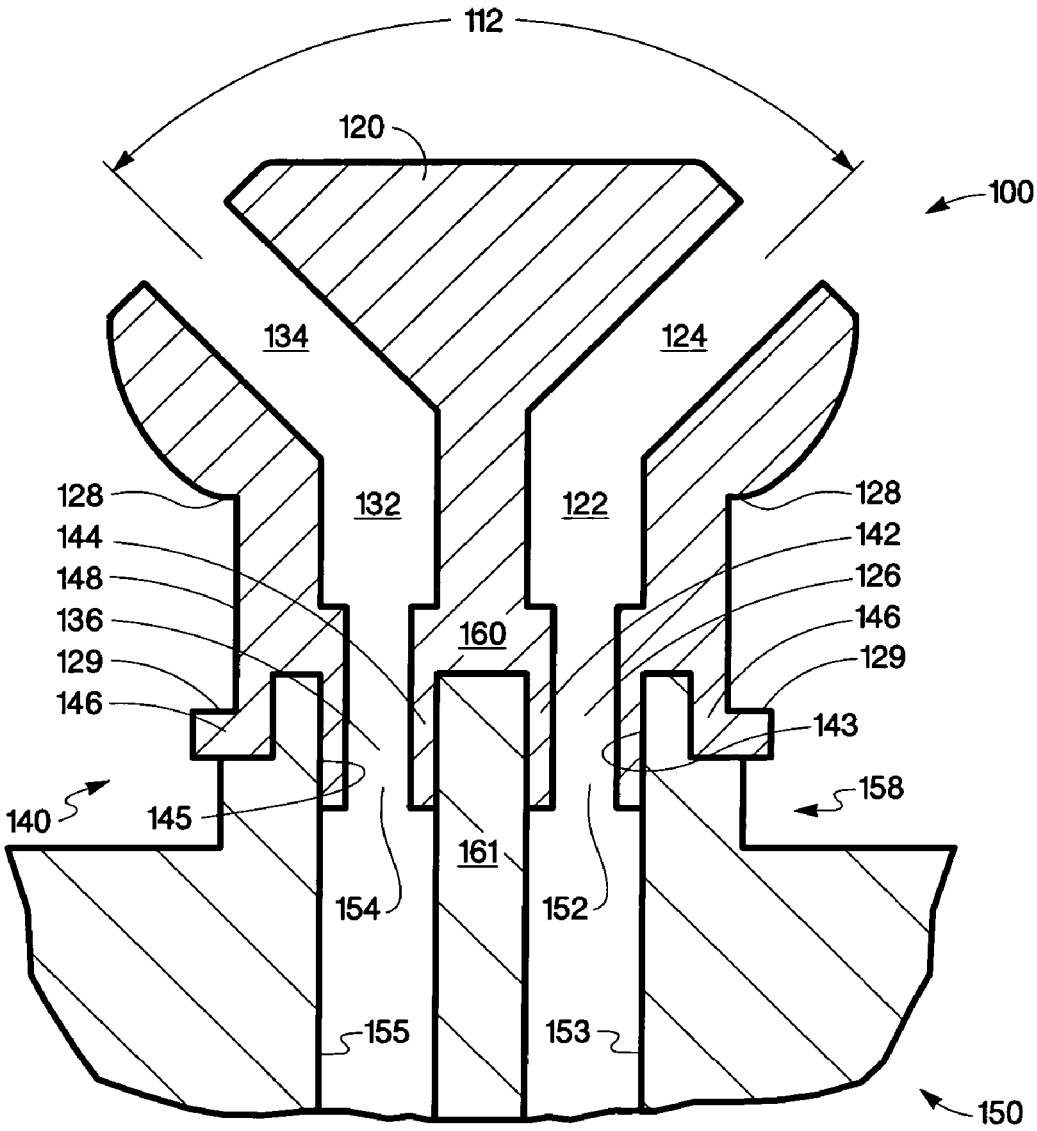
FIG. 1*a* is a cross-sectional view of a viscoelastic liquid flow splitter according to an embodiment of the present invention.

The present invention advantageously utilizes a viscoelastic liquid flow splitter, as part of a dispensing apparatus, to dispense quantities of a viscoelastic fluid of a precise volume. The viscoelastic liquid flow splitter is a device that keeps two reactive components separated as the two components are discharged from a storage container having multiple compartments. For example, a two-part adhesive such as a two part epoxy is stored in a double-barreled syringe where the epoxy resin is stored in one barrel or compartment and the hardener is stored in a second barrel or compartment. In addition, the dispensing apparatus may include at least two input channels feeding into a dispenser chamber having at least one feed screw, also commonly referred to as an auger, to both mix the components and dispense the liquid product. The viscoelastic liquid flow splitter keeps the two components separated until they are mixed and dispensed in a substantially simultaneous manner, thereby enabling the dispensing of multi-component liquids cost effectively utilizing conventional storage containers such as the double barreled syringe used by the adhesive industry.

Other examples of various viscoelastic fluids that may be dispensed utilizing such an apparatus include other adhesives, lubricants, underfill materials, solder pastes or other materials that generally have a viscosity of the order of 10,000 to 1,500,000 Centipoise. The dispensing apparatus of the present invention may accurately dispense viscoelastic materials as isolated structures commonly referred to as dots of the order of 0.2 to 25 mm in diameter with a height of the order of 0.2 to 2 mm. The storage container and viscoelastic liquid flow splitter generally are coupled to the dispensing apparatus. The dispensing apparatus also may accurately dispense a bead of fluid product of the order of 0.2 to 4 mm in width and 0.2 to 4 mm in height at rates of the order of 5 micro-liters per second to 100 micro-liters per second. Even larger volumes may be dispensed by increasing the diameter of the chamber and feed screw.

It should be noted that the drawings are not true to scale. Further, various elements have not been drawn to scale. Certain dimensions have been exaggerated in relation to other dimensions in order to provide a clearer illustration and understanding of the present invention. In particular, vertical and horizontal scales may differ and may vary from one drawing to another. In addition, although some of the embodiments illustrated herein are shown in two dimensional views with various regions having height and width, it should be clearly understood that these regions are illustrations of only a portion of a device that is actually a three dimensional structure. Accordingly, these regions will have three dimensions, including length, width, and height, when fabricated on an actual device.

Moreover, while the present invention is illustrated by various embodiments, it is not intended that these illustrations be a limitation on the scope or applicability of the present invention. Further, it is not intended that the embodiments of the present invention be limited to the physical structures illustrated. These structures are included to demonstrate the utility and application of the present invention to presently preferred embodiments.

A cross-sectional view of an embodiment of viscoelastic liquid flow splitter 100 employing the present invention is illustrated in FIG. 1*a*. In this embodiment, viscoelastic liquid flow splitter 100 includes flow splitter body 120 having first bore 122 and second bore 132 formed therein. First bore 122 includes first bore outlet 124 and first bore inlet 126. Second bore 132 includes second bore outlet 134 and second bore inlet 136. First and second bore inlets 126, 136 are substantially parallel to each other, whereas first and second bore outlets 124, 134 diverge from each other at angle 112.

Viscoelastic liquid flow splitter 100 also includes compression fitting 140 that includes first and second tubular portions 142, 144 fluidically coupled to the first and second bore inlets. In this embodiment, compression fitting 140 is adapted to and/or configured to fluidically couple to double barreled viscoelastic liquid dispensing syringe 150. In this embodiment, double barreled viscoelastic liquid dispensing syringe 150 includes first viscoelastic liquid outlet 152 and second viscoelastic liquid outlet 154 that are substantially coaxial with first and second tubular portions 142, 144 and with first and second bore inlets 126, 136 respectively. First and second viscoelastic liquid outlets 152, 154 also include first and second internal surfaces 153, 155 respectively. Compression fitting 140, in this embodiment, includes first external tubular surface 143 and second external tubular surface 145 (also see FIG. 1*c*) adapted and/or configured to compress against first internal surface 153 and second internal surface 155 respectively providing a fluidic seal between the flow splitter and the dispensing syringe. First and second tubular portions 142, 144, also include fluid isolating structure 160 and first and second viscoelastic liquid outlets 152, 154 include syringe fluid isolating structure 161 each configured to isolate a first viscoelastic liquid component from a second viscoelastic liquid component either preventing or at least substantially hindering intermixing of the two viscoelastic liquid components. Fluid isolating structure 160 mates or butts against syringe fluid isolating structure 161 when flow splitter 100 is attached to double barreled viscoelastic liquid dispensing syringe 150 double barreled viscoelastic liquid dispensing syringe 150.

Figure 1B:
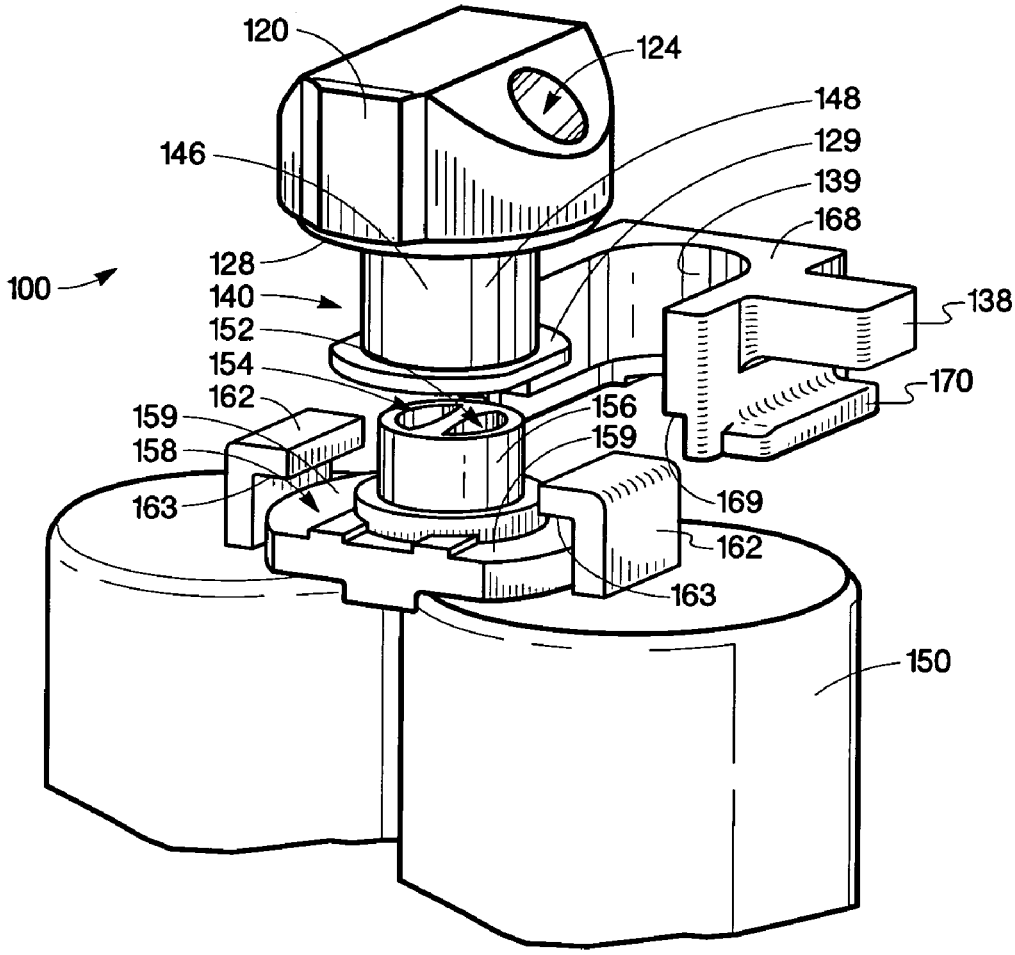
FIG. 1*b* is an exploded perspective view of a portion of a dispensing apparatus according to an embodiment of the present invention.

In addition, compression fitting 140 includes outer compression portion 146 having compression circumferential surface 147 (see FIG. 1*c*) configured to compress against syringe circumferential surface 156 (see FIG. 1*b*). Syringe circumferential surface 156 is formed proximate to dispensing portion 158 of double barreled viscoelastic liquid dispensing syringe 150. In this embodiment, outer compression portion 146 is substantially coaxial with first and second tubular portions 142, 144.

Figure 1C:
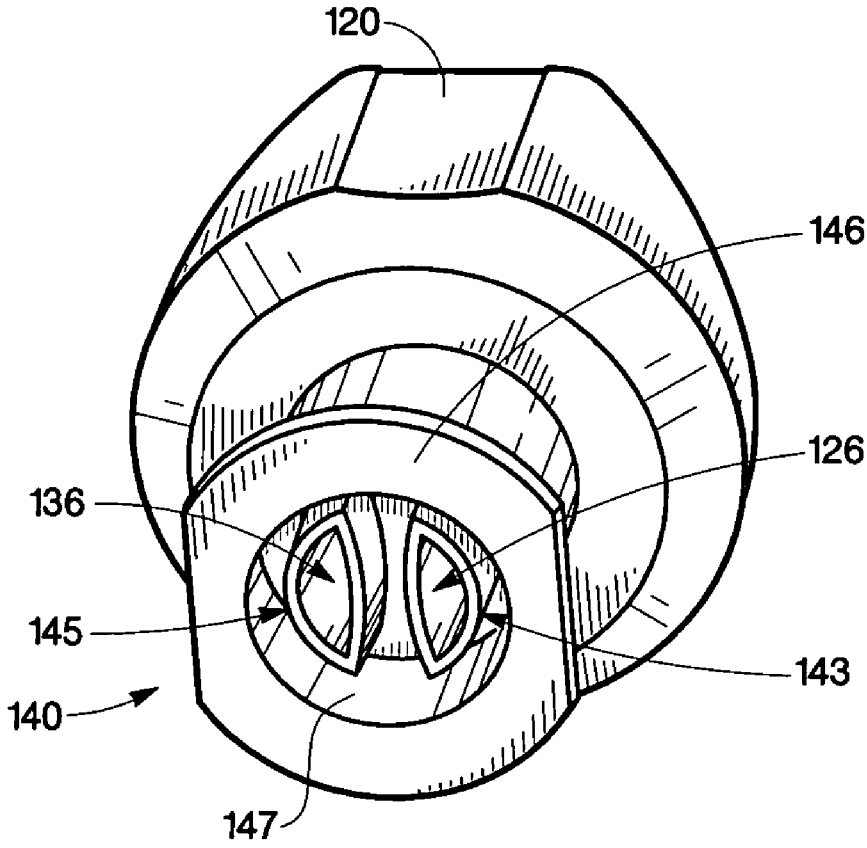
FIG. 1*c* is a perspective view of the viscoelastic liquid flow splitter, illustrated in FIG. 1*a*, showing the two inlet portions of the viscoelastic liquid flow splitter.

Viscoelastic liquid flow splitter 100 may be formed from a wide variety of materials including various polymeric, metallic, and ceramic materials. In addition, the viscoelastic liquid flow splitter may be formed utilizing a wide variety of techniques such as injection molding, machining, thermoforming, compression molding as just a few examples. Further, first and second tubular portions 142 and 144 as well as first and second bore outlets 124 and 134 may have a wide variety of shapes. Generally, the first and second tubular portions will have a shape substantially matching the internal shape of first and second viscoelastic liquid outlets 152, 154 as shown in FIGS. 1*b* and 1*c*.

Figure 1D:
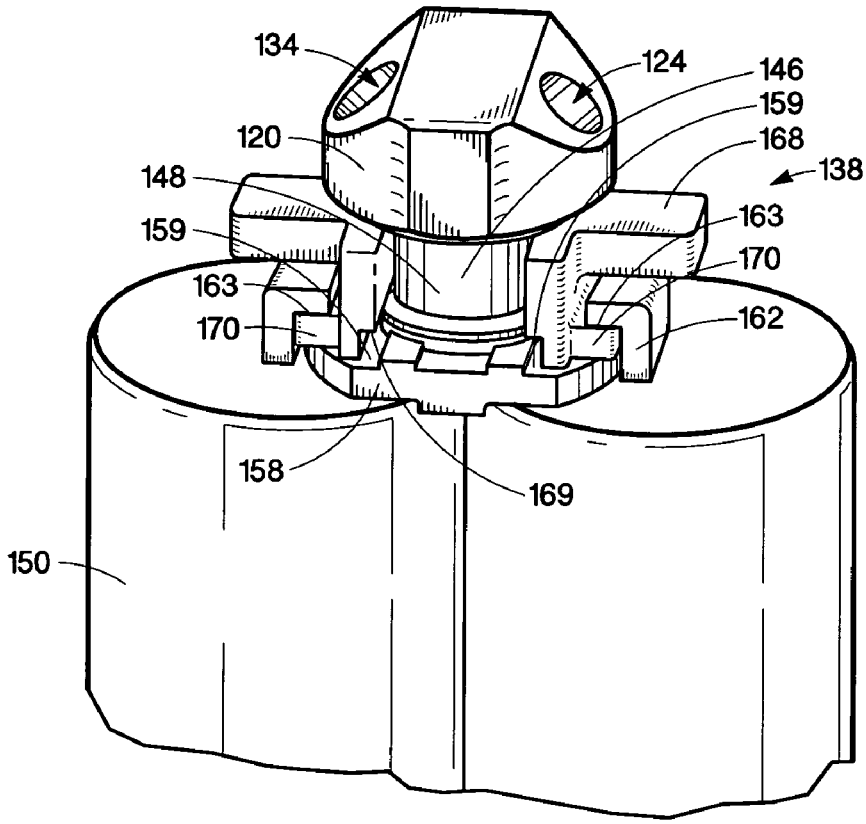
FIG. 1*d* is a perspective view of the assembled dispensing apparatus shown in FIG. 1*b*.

As shown in FIGS. 1*b* and 1*d* viscoelastic liquid flow splitter 100 also includes locking collar 138 that is adapted and/or configured to clamp and/or securely attach viscoelastic liquid flow splitter 100 to double barreled viscoelastic liquid dispensing syringe 150. In this embodiment, locking collar 138 includes U shaped collar portion 139 adapted and/or configured to slide and/or slip around flow splitter collar surface 148. Flow splitter 100 also includes upper collar stop 128 (also see FIG. 1*a*) configured and/or adapted to securely hold locking collar flow splitter surface 168. Flow splitter 100 includes lower collar flange 129 (also see FIG. 1*a*) configured and/or adapted to securely hold locking collar flange mating surface 169. In this embodiment, double barreled viscoelastic liquid dispensing syringe 150 also includes syringe locking structures 162 disposed either on or proximate to dispensing portion 158. Syringe locking structures 162 include locking structure surface 163 wherein locking structures 162 form a gap between locking structure surface 163 and syringe dispensing portion surface 159. Locking collar 138 includes syringe engagement portions 170 wherein when locking collar 138 is engaged with locking structures 162 a securing force is exerted against syringe engagement portions 170 and locking structure surface 163 and syringe dispensing portion surface 159. In alternate embodiments, a wide variety of other locking mechanisms also may be used. For example, a threaded collar that engages onto a threaded portion of the syringe may be utilized. Another example utilizes screws or bolts to attach the flow splitter to the syringe body. Still another example utilizes a collar type clamp (e.g. a clamp similar to that used to clamp vacuum flanges together) to clamp the flow splitter to the syringe body. Finally, the syringe body may integrally include the flow splitter formed as part of the syringe body such as using injection molding to form the syringe body.

Figure 2:
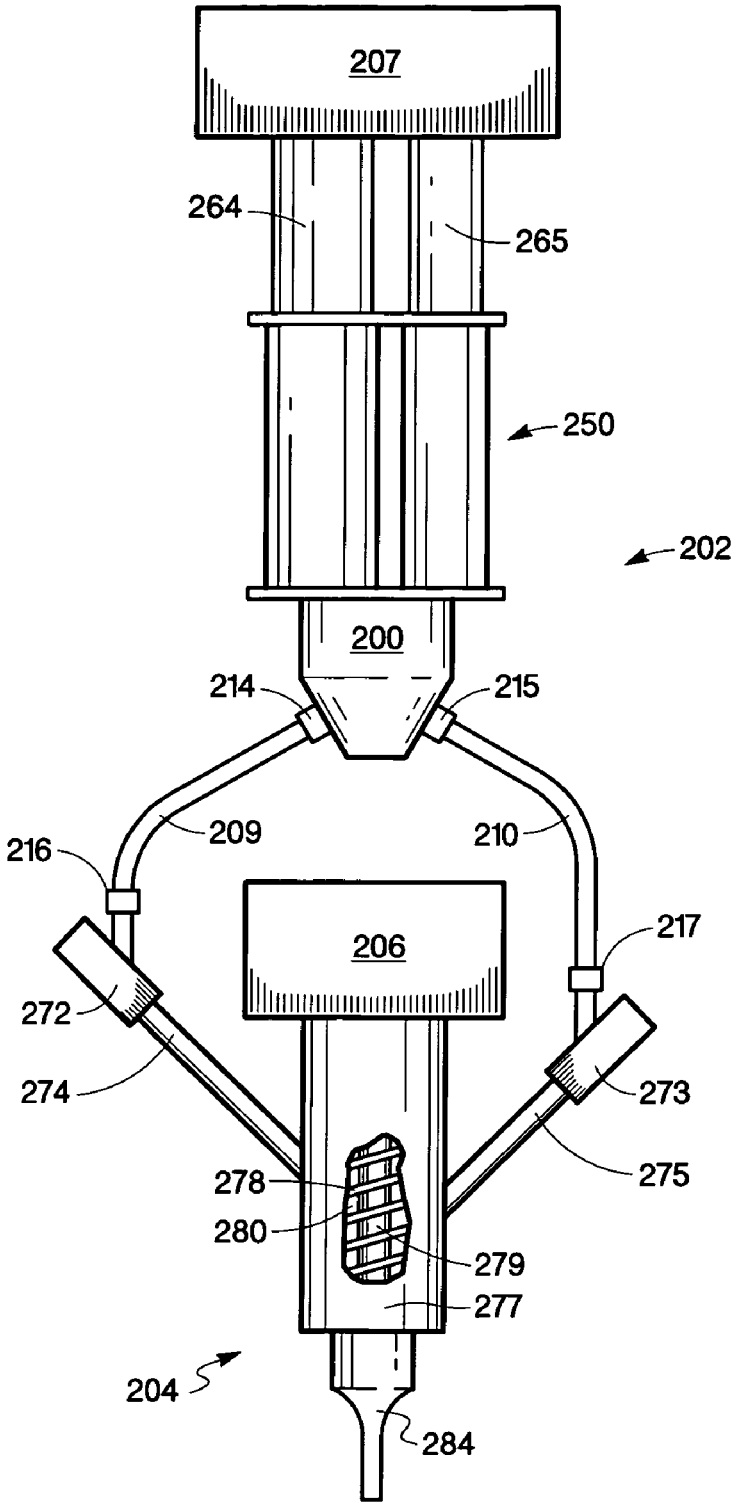
FIG. 2 is a schematic diagram of a dispensing apparatus according to an embodiment of the present invention.

A schematic diagram of an embodiment of a dispensing apparatus according to the present invention is shown in FIG. 2. In this embodiment, viscoelastic liquid flow splitter 200 is attached to double barreled viscoelastic liquid dispensing syringe 250. Double barreled viscoelastic liquid dispensing syringe 250 includes first and second syringe plungers 264 and 265, which are coupled to plunger drive mechanism 207. The plunger drive mechanism applies a force to the first and second syringe plungers which in turn controls the rate of dispensing of both a first and a second viscoelastic liquid separately contained in the double barreled syringe. As first syringe plunger 264 is urged toward the viscoelastic liquid flow splitter the first viscoelastic liquid is forced through the first viscoelastic liquid outlet of the double barreled syringe and into the first bore inlet of the viscoelastic liquid flow splitter. Likewise as second syringe plunger 265 is urged toward the viscoelastic flow splitter the second viscoelastic liquid is forced through the second viscelastic liquid outlet of the double barreled syringe and into the second bore of the viscoelastic flow splatter. First and second bore couplings 214 and 215 couple first and second tubes 209 and 210 to the first and second bore outlets respectively of the flow splitter. Similarly first and second valve couplings 216 and 217 couple first and second tubes 209 and 210 to the first and second inlet shutoff valves 272 and 273 respectively. First and second inlet shutoff valves 272 and 273 are fluidically coupled to chamber 280 formed in dispenser body 277 of positive displacement apparatus 204 via first and second dispenser inlet channels 274 and 275 respectively. Positive displacement apparatus 204 also includes feedscrew 279 that slidably fits in chamber 280. Feedscrew 279 is rotated by dispenser drive mechanism 206. As feedscrew 279 is rotated threads 278 force both the first and second viscoelastic liquids that are captured between the threads and the walls of chamber 280 to compress and to move in the direction of dispenser tip 284. As the first and second viscoelastic liquids are forced toward the dispenser the feedscrew substantially simultaneously mixes and accurately dispenses the viscoelastic product formed by mixing the two viscoelastic liquids. Positive displacement apparatus provides the accurate control of the amount of rotation of feedscrew 279 to generate a precise control of the rate of feed and subsequent volume of viscoelastic liquid product dispensed without an intervening valve between the chamber and the dispenser tip.

The viscoelastic dispensing apparatus 202 shown in FIG. 2 mixes two different liquid components to form a viscoelastic liquid product and accurately dispenses a predetermined amount of the viscoelastic liquid product onto a surface or adherend in a manufacturing process, utilizing the at least one feed screw located in the chamber to both mix and substantially simultaneously dispense the viscoelastic liquid product. The viscoelastic liquid product generally will have a viscosity of the order of about 20,000 to about 1,000,000 Centipoise. In those embodiments where the positive displacement apparatus is used to dispense a two-part epoxy adhesive the epoxies will have a viscosity in the range from about 30,000 to about 1,000,000 Centipoise. Although epoxies in the viscosity range from about 20,000 to about 29,000 Centipoise may also be used epoxies in this range will not have the same pumping efficiency as epoxies with a viscosity greater than or equal to 30,000 Centipoise due to some material slippage within the chamber of positive displacement apparatus 204. In addition, a wide variety of materials as previously mentioned may be accurately dispensed from viscoelastic dispensing apparatus 202 as isolated structures commonly referred to as dots onto a surface or adherend of the order of 0.2 to 1.5 mm in diameter with a height of the order of 0.2 to 1 mm. A bead of viscoelastic liquid product of the order of 0.2 to 1.5 mm in width and 0.2 to 1 mm in height at rates of the order of 0.4 to 0.8 milliliters per minute may also be dispensed using this embodiment.

Figure 3A:
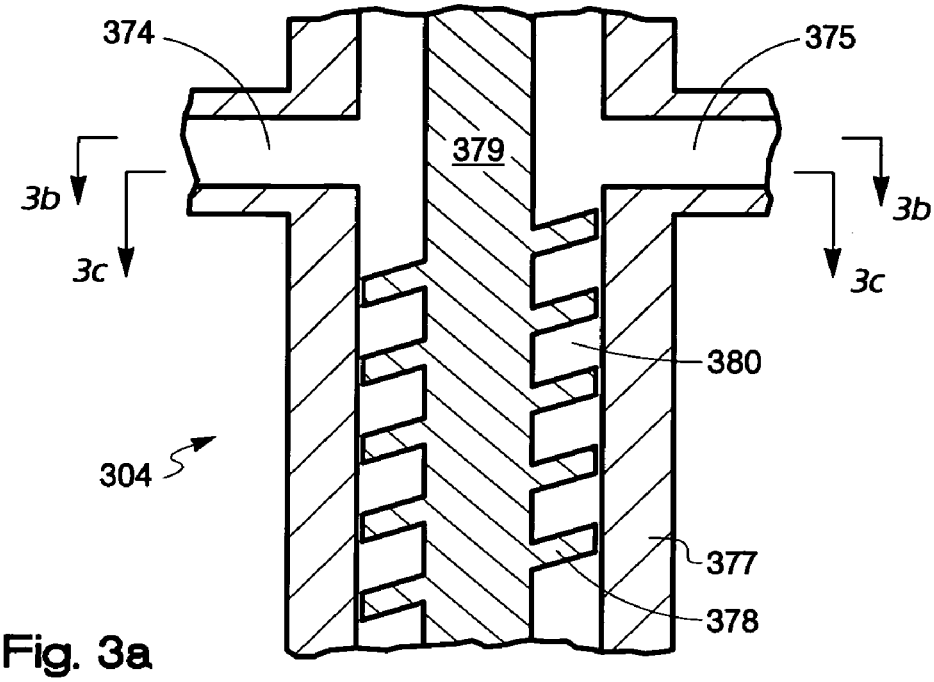
FIG. 3*a* is a cross-sectional view of a dispensing apparatus having a feed screw including positive shutoff mechanisms according to an alternate embodiment of the present invention.
Figure 3B:
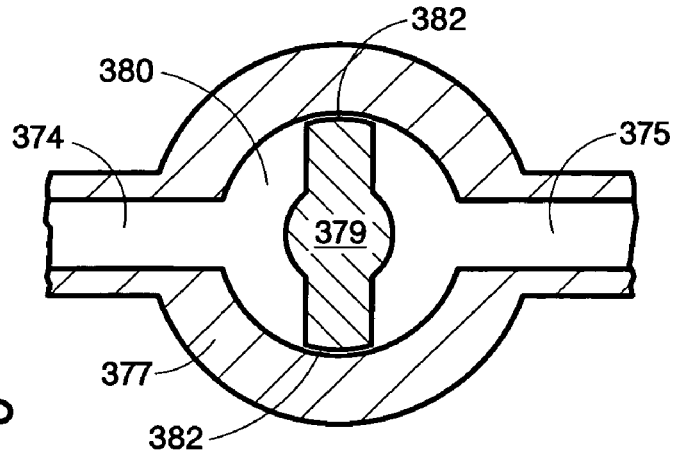
FIG. 3*b* is a cross-sectional view along 3*b*-3*b* of the feed screw and positive shutoff mechanisms shown in FIG. 3*a*.
Figure 3C:
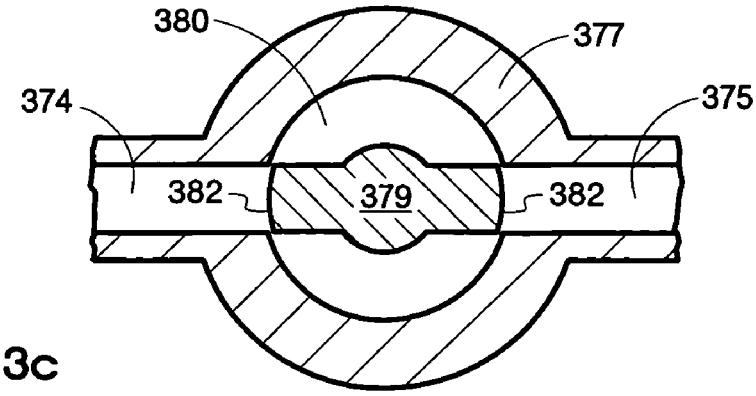
FIG. 3*c* is a cross-sectional view along 3*c*-3*c* of the feed screw and positive shutoff mechanisms shown in FIG. 3*a*.

An alternate embodiment of a positive displacement apparatus of the present invention is shown in a cross-sectional view in FIGS. 3*a*-3*c*. In this embodiment, positive displacement apparatus 304 includes positive shutoff mechanisms 382 (see FIGS. 3*b* and 3*c*) integrally formed on feed screw 379 that is disposed in chamber 380 formed in dispenser body 377. Positive shutoff mechanisms 382 are configured to engage first and second dispenser inlet channels 374 and 375 to substantially completely close the inlet channel with respect to the supply of viscoelastic liquid components from the double barreled viscoelastic liquid dispensing syringe. The feed screw, in this embodiment, is physically isolated from the double barreled syringe when the positive shutoff mechanisms are engaged. Since the positive shutoff mechanisms are integrally formed as part of the feed screw the positive shutoff mechanisms are downstream from the supply syringe. As a result, the volume of material that resides down stream from the supply syringe may be minimized. By minimizing the downstream volume of material the flow variability of the positive displacement apparatus 304 due to compressibility effects of the viscoelastic liquid product being dispensed is reduced. As feedscrew 379 is rotated helical threads 378 force both the first and second viscoelastic liquids that are captured between the threads and the walls of chamber 380 to compress and move toward the outlet of the positive displacement apparatus. As the first and second viscoelastic liquids are forced toward the dispenser the feedscrew substantially simultaneously mixes and accurately dispenses the viscoelastic product formed by mixing the two viscoelastic liquids.

In the embodiment illustrated in FIGS. 3*a*-3*c*, the positive shutoff mechanisms are formed as cammed lobes; however, in alternate embodiments a wide variety of shapes and structures may also be utilized. The positive shutoff mechanisms are coupled via the feed screw and the dispenser drive mechanism to a controller (not shown) that is configured to control the rotation of the feed screw. This rotation causes the cammed lobes to move between contact and non-contact with the first and second dispenser inlet channels 374 and 375. During a dispensing operation the controller directs the feed screw or auger 379 to rotate at a substantially continuous rate. When dispensing operations are paused or stopped, the controller causes the dispenser drive mechanism to stop the rotation of the feed screw so that the positive shutoff mechanisms 382 are in physical contact with the first and second dispenser inlet channels 374 and 375 so that sealing shoulders of the positive shutoff mechanisms cover and/or seal against the inlet channels. This physical contact substantially isolates the feed screw and chamber from a supply reservoir. Thus, as illustrated in FIG. 3*b* non-contact refers to the cammed lobes displaced from the inlet channels allowing viscoelastic liquid components to flow through the inlet channels, whereas, as illustrated in FIG. 3*c* contact refers to the cammed lobes sealing against the inlet channels either preventing or at least substantially hindering material flow through the inlet channels into the chamber. As a result, once the positive shutoff mechanisms are engaged, material being fed through the inlet channels is stopped. Consequently, in some embodiments the selective engagement of the positive shutoff mechanism alone may be sufficient to control material flow from the supply syringe to the feedscrew allowing one to simplify the dispensing system by removing the first and second shutoff valves shown in FIG. 2. In still other embodiments both the first and second shutoff valves as well as the positive shutoff mechanisms may be utilized.

In addition, the use of the positive shutoff mechanisms may allow the supply syringe to be held at a constant pressure because pressure variations in the supply syringe are not utilized to control the flow of the viscoelastic liquid components when the system is not dispensing. The ability to maintain the supply syringe at constant pressure enhances the precision with which the dispensing system can deliver material by minimizing pressure variations during startup. Material that remains trapped in the feed screw chamber while the positive shutoff mechanisms are engaged, is prevented from drooling from the dispenser tip and out onto the medium due to the viscosity of the material and not due to pressure. That is because a minimal amount of material is trapped downstream and because the pressure in the supply syringe is isolated from the feed screw chamber the viscosity of the material in the feed screw chamber prevents the material from drooling or leaking out.

Figure 4:
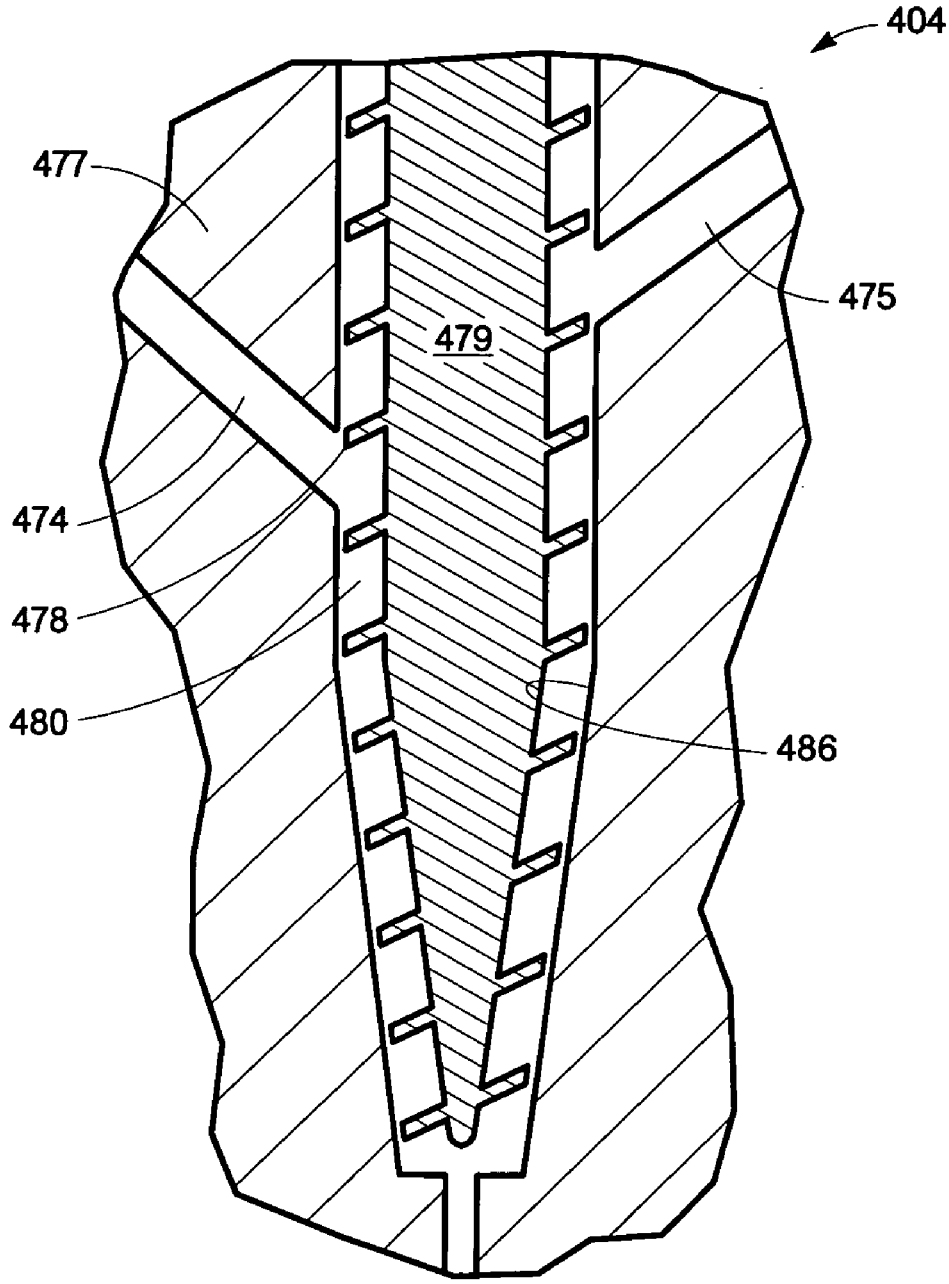
FIG. 4 is a cross-sectional view of a feed screw according to an alternate embodiment of the present invention.

An alternate embodiment of the present invention is shown in a cross-sectional view in FIG. 4. Positive displacement apparatus 404 includes feed screw 479 that has a conical or tapered shape with helical threads 478 having a linear pitch. Feed screw 479, in alternate embodiments, can include sections with various configurations of helical threads. Those skilled in the art will appreciate that kneading threads, reverse threads, variable pitch thread, cylindrical sections with no threads all can be utilized in various combinations as well as numerous other thread designs.

When feed screw 479 is rotated helical threads 478 are in sliding contact with side wall 486 of chamber 480 formed in dispenser body 477. As first and second liquid components are fed into chamber 480 via first and second dispenser inlet channels 474 and 475 the reduction in area created by the smaller diameter of the tapered shape produces a reduction in volume leading to an increase in pressure similar to that obtained with a feed screw having helical threads with a relatively wide pitch near the top portion of the feed screw or the portion of the feed screw closest to the dispenser drive mechanism ( see e.g. 207 in FIG. 2) the threads becoming narrower and closer together as the threads approach the bottom portion of the feed screw or the portion of the feed screw closest to the dispenser tip (see e.g. 284 in FIG. 2).

Figure 5A:
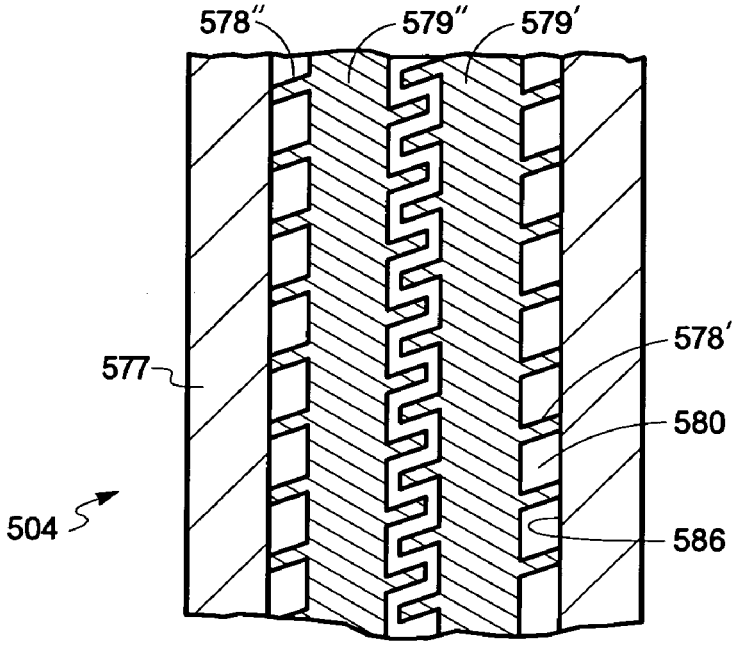
FIG. 5*a* is a cross-sectional view of a dispensing apparatus having two feed screws with partially overlapping helical threads according to an alternate embodiment of the present invention.

An alternate embodiment of the present invention is shown, in a cross-sectional view, in FIG. 5*a*. Positive displacement apparatus 504, in this embodiment, includes two feed screws 579' and 579" located within chamber 580. In this embodiment, chamber 580 includes two circular bores formed in dispenser body 577 which have parallel axes and extend centrally and longitudinally through dispenser body 577. The circular bores communicate with each other along a common chord. Feed screws 579' and 579" are rotatably supported within the circular bores of the chamber and are in sliding contact with side wall 586. Typically a gap is maintained between helical threads 578' and 578" and side wall 586. Generally this gap is of the order of 0.0001 to 0.0008 inches, but may be smaller or larger depending on the particular application in which positive displacement apparatus 504 is to be used. Helical threads 578' and 578", in this embodiment, are partially overlapping along the chord. As feed screws 579' and 579" are rotated helical threads 578' and 578" are engaging each other in a meshing manner, as illustrated in FIG. 5*a*, causing first and second component viscoelastic liquids located in the turns of the helical threads to move in the axial direction causing mixing of the components and the dispensing of liquid product. The intermeshing of the helical threads results in a volumetric transport of material. Feed screws 579' and 579" can run in two modes: co-rotating and counter-rotating depending on screw design where typically co-rotating feed screws can be operated at higher speeds.

The incorporation of two feed screws 579' and 579" in chamber 580 provides a dispenser which can dispense both, a wider range of viscosities, especially for viscoelastic materials at the low end of the viscosity range, as well as a when there is a large particle size variation in the materials being mixed. In addition, two feed screws also provide improved mixing since the fluidic dynamics are much more complex. Thread configurations are also more flexible utilizing two feed screws. Further, when they are intermeshing, two feed screws are typically self-wiping (i.e. self cleaning). Finally, feed screws 579' and 579" can include sections with various configurations of helical threads. A wide variety of threads may be utilized including kneading threads, reverse threads, variable pitch thread, cylindrical sections with no threads all can be utilized in various combinations as well as numerous other thread designs.

Figure 5B:
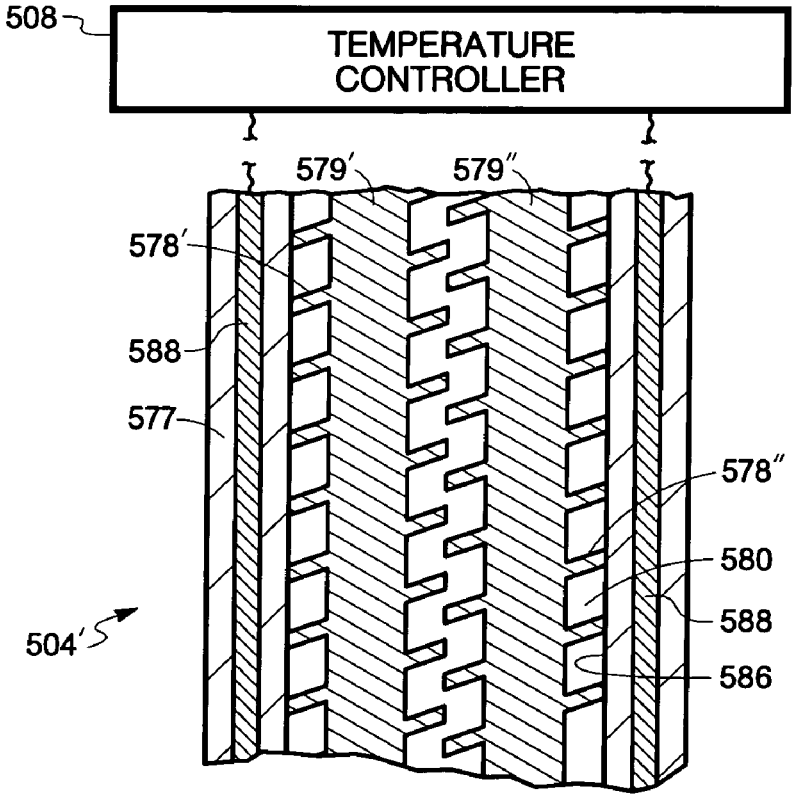
FIG. 5*b* is a cross-sectional view of a dispensing apparatus having two feed screws and heating elements according to an alternate embodiment of the present invention.

An alternate embodiment of the present invention is shown, in a cross-sectional view, in FIG. 5*b*. Positive displacement apparatus 504', in this embodiment, includes two feed screws 579' and 579" located within chamber 580 that includes two non-overlapping cylindrical bores. In this embodiment, chamber 580 includes two circular bores formed in dispenser body 577. The circular bores have parallel axes and extend centrally and longitudinally through dispenser body 577. The distance between the axes of the two circular bores is greater than the sum of the radiuses of the two circular bores. Thus, the two circular bores communicate with each other through a common opening. Feed screws 579' and 579" are rotatably supported within the circular bores of chamber 580. In this embodiment, helical threads 578' and 578" are non-overlapping. In addition, feed screws 579' and 579" can include sections with various configurations of helical threads as discussed above.

Figure 5C:
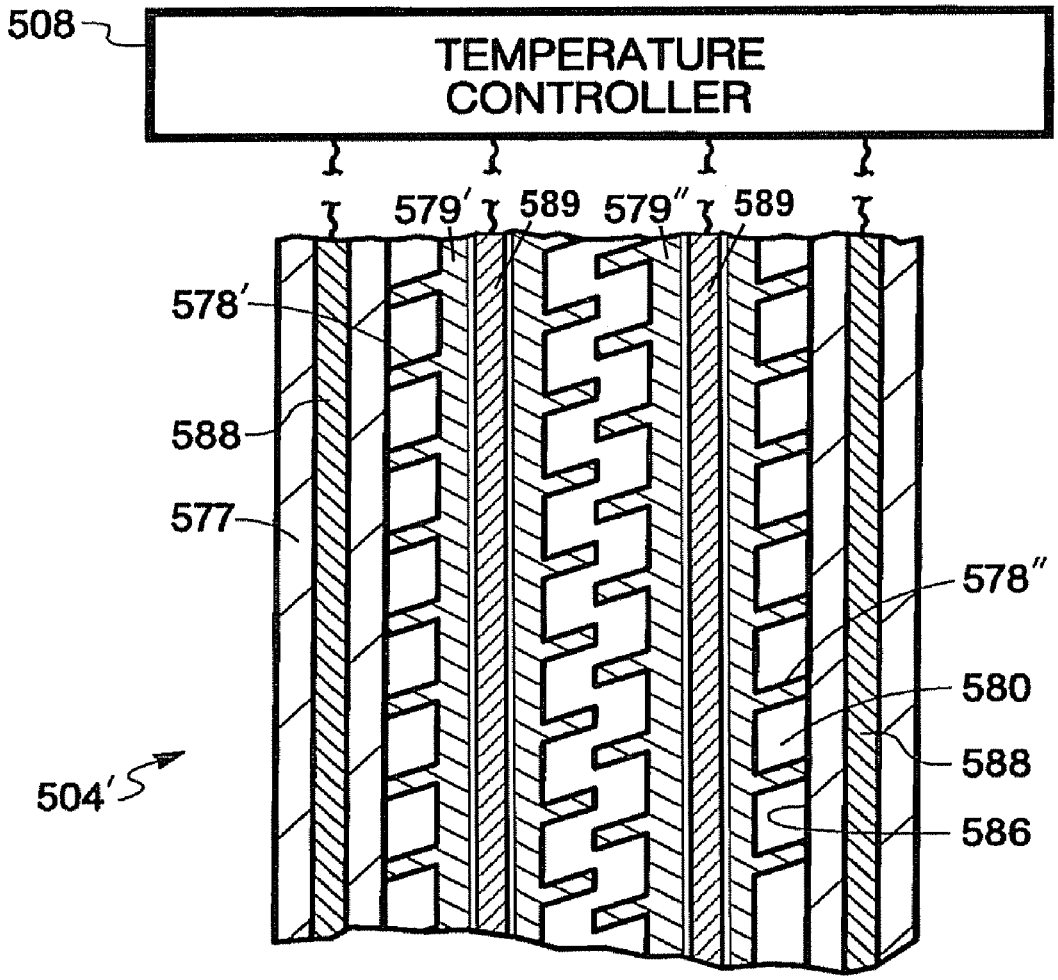
FIG. 5*c* is a cross-sectional view of a dispensing apparatus having two feed screws and heating elements according to an alternate embodiment of the present invention.

In this embodiment, dispenser body 577 may be heated by body heaters 588. In addition, in alternate embodiments, the feed screw or feed screws also may be heated by using feed screw heaters. For example, in the embodiment illustrated in FIG. 5*c*, at least one heating element 589 is disposed in the feed screws. In the embodiment illustrated in FIG. 5*b*, body heaters 588 are disposed within heater cavities formed in dispenser body 577. The body heaters 588, and in those embodiments using feed screw heaters, the heaters are electrically coupled to temperature controller 508 to control the temperature of the dispenser body and feed screws. In one alternate embodiment a body heater may be formed utilizing a heating tape wrapped around the dispenser body. The heaters heat the viscoelastic fluid located within chamber 580 to a temperature in the range from about 30° C. to about 150° C. The particular temperature utilized will depend on various factors such as the temperature dependence of the viscosity of the viscoelastic fluid being dispensed, the dispensing rate, and the repeatability and accuracy of the structure dispensed. Heating the viscoelastic fluid in chamber 580 provides for additional control of the viscosity of the fluid and in particular heating provides for the dispensing of highly viscous fluids that would be difficult to dispense without heating. For example, heating of the viscoelastic fluid in the chamber to just above room temperature results in a small reduction in viscosity but also provides for a more constant temperature that adds additional control over dispensing accuracy and repeatability than typically obtained with the normal ambient temperature swings encountered in most environments. In this embodiment, the body heaters are formed from nichrome heating wire; however, in alternate embodiments other heating techniques also may be used. For example, infrared heaters, hot gas or liquid, or other metal, metal alloy or conductive materials to form the heating elements, also may be used to heat either the body heaters, the feed screws or both. In still another embodiment, the body heater, using for example thick film processing techniques, may be formed around or on portions of the outer surface of the dispenser body.

Figure 6:
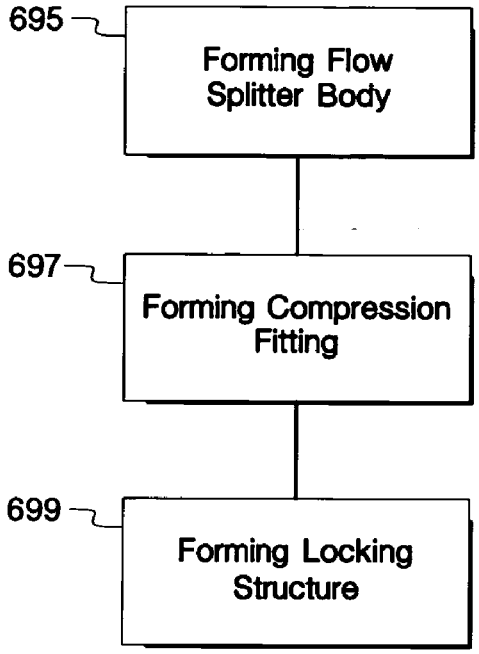
FIG. 6 is a flow chart of a method of making a viscoelastic liquid flow splitter according to an embodiment of the present invention.

A flow chart of a method of making a viscoelastic liquid flow splitter according to an embodiment of the present invention is shown in FIG. 6. In this embodiment, body forming process 695 is utilized to form the flow splitter body that may be utilized in a viscoelastic liquid dispensing system. Generally, the body forming process utilizes injection molding; however, a wide variety of processes such as blow molding, thermoforming, compression molding, or machining may be utilized to form the flow splitter body. Body forming process 695 includes forming a body that includes a first bore and a second bore. Each bore having an outlet portion and an inlet portion wherein the first and second inlet portions are substantially parallel to each other and the first and second outlet portions diverge from each other at an angle. Generally, the angle of divergence is about 90 degrees where the angle between the first inlet and first outlet as well as the second inlet and second outlet is about 45 degrees; however, in alternate embodiments the angle of divergence may be any of a wide range of angles that provides for easy fluidic connection of the flow splitter body to the first and second dispenser inlet channels of the positive displacement apparatus. In addition, the method of making the flow splitter body also includes compression fitting forming process 697 where the compression fitting has a first and a second tubular portion fluidically coupled to the first and second inlet portions. Both the first and second tubular portions are configured to fluidically couple to a double barreled viscoelastic liquid dispensing syringe.

Depending on the particular mounting mechanism used to attach the flow splitter body to the double barreled viscoelastic liquid dispensing syringe, the method of making the flow splitter may optionally include locking structure forming process 699 to form a locking structure that securely attaches the flow splitter body to the syringe. In addition, in those embodiments using tubing to connect the flow splitter body to the positive displacement apparatus, the method of making the flow splitter body may optionally include forming a first and a second fluidic coupling that attaches to the first and second outlet portion respectively of the flow splitter body.

Figure 7:
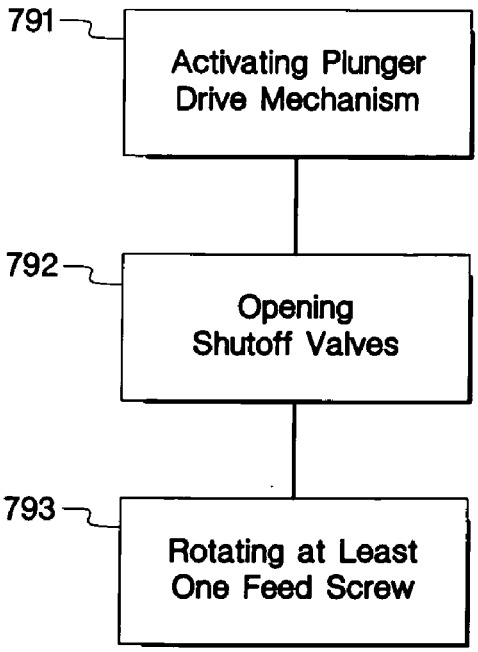
FIG. 7 is a flow chart of a method of using a viscoelastic liquid flow splitter according to an embodiment of the present invention.

A flow chart of a method of using a viscoelastic liquid flow splitter according to an embodiment of the present invention is shown in FIG. 7. In this embodiment, plunger drive mechanism activation process 791 is utilized to force a first component viscoelastic liquid from a first viscoelastic liquid outlet and a second component viscoelastic liquid from a second viscoelastic liquid outlet of a double barreled viscoelastic liquid dispensing syringe into the first inlet portion of the first bore and the second inlet portion of the second bore of the viscoelastic liquid flow splitter. As viscoelastic liquid is forced out of the double barreled syringe the first and second components are urged through the first and second bores and out the first and second outlet portions. In those embodiments utilizing shutoff valves attached to the first and second dispenser inlet channels, optional shutoff valve opening process 792 may be utilized to open first and second inlet shutoff valves fluidically coupled to first and second dispenser inlet channels of the positive displacement apparatus. As viscoelastic liquid is forced out of the syringe and urged through the flow splitter the first and second components are urged through the first and second dispenser input channels into a feed screw chamber of the positive displacement apparatus. Feedscrew rotation process 793 is used to rotate at least one feed screw that is disposed in the feed screw chamber. Rotation of the at least one feed screw mixes the first and second component viscoelastic liquids to form a liquid product and discharges substantially simultaneously a portion of the liquid product so formed from a dispenser tip coupled to the feed screw chamber.

What is claimed is:

1. A viscoelastic liquid dispensing system, comprising:

a double barreled liquid dispensing syringe;

a flow splitter body of one-piece contruction fluidically coupled to the double barreled liquid dispensing syringe, the flow splitter body having:

a first bore including a first outlet portion, a first inlet portion, and a first intermediate portion extended between the first outlet portion and the first inlet portion, the first outlet portion having a cylindrical length defined, in cross-section, by substantially parallel sidewalls extended between a first end communicated, at all times, with the first inlet portion via the first intermediate portion and a second end having a first outlet opening, a second bore including a second outlet portion, a second inlet portion, and a second intermediate portion extended between the second outlet portion and the second inlet portion, the second outlet portion having a cylindrical length defined, in cross-section, by substantially parallel sidewalls extended between a first end communicated, at all times, with the second inlet portion via the second intermediate portion and a second end having a second outlet opening, wherein the first and second inlet portions are substantially parallel to each other, wherein the first and second intermediate portions are substantially parallel to each other, and wherein the first and second outlet portions diverge from each other at an angle over the cylindrical lengths thereof from the first ends thereof to the first and second outlet openings, and a compression fitting having first and second tubular portions fluidically coupled to the first and second inlet portions, and an outer compression portion substantially coaxial with the first and second tubular portions, wherein the first and second tubular portions of the compression fitting are fluidically coupled to the double barreled liquid dispensing syringe; and a feed screw chamber having at least one feed screw disposed therein, the feed screw chamber including a first input channel fluidically coupled to the first outlet portion of the flow splitter body and a second input channel fluidically coupled to the second outlet portion of the flow splitter body.

2. The viscoelastic liquid dispensing system in accordance with claim 1, wherein said first tubular portion of said compression fitting is substantially coaxial with said first inlet portion and with a first viscoelastic liquid outlet of said double barreled liquid dispensing syringe, and wherein said second tubular portion of said compression fitting is substantially coaxial with said second inlet portion and with a second viscoelastic liquid outlet of said double barreled liquid dispensing syringe.

3. The viscoelastic liquid dispensing system in accordance with claim 2, wherein said first and second tubular portions of said compression fitting further comprise a fluid isolating structure, and wherein said first and second viscoelastic liquid outlets of said double barreled liquid dispensing syringe further comprise a syringe fluid isolating structure, said fluid isolating structure and said syringe fluid isolating structure configured to isolate a first viscoelastic liquid from a second viscoelastic liquid, substantially hindering intermixing when said first viscoelastic liquid flows from said first viscoelastic liquid outlet to said first inlet portion and said second viscoelastic liquid flows from said second viscoelastic liquid outlet to said second inlet portion.

4. The viscoelastic liquid dispensing system in accordance with claim 2, wherein a first external tubular surface of said first tubular portion of said compression fitting compresses against a first internal surface of said first viscoelastic liquid outlet of said double barreled liquid dispensing syringe, and wherein a second external tubular surface of said second tubular portion of said compression fitting compresses against a second internal surface of said second viscoelastic liquid outlet of said double barreled liquid dispensing syringe.

5. The viscoelastic liquid dispensing system in accordance with claim 1, wherein said compression fitting further comprises an outer compression portion configured to compress against a syringe circumferential surface formed by a dispensing portion of said double barreled liquid dispensing syringe, said outer compression portion substantially coaxial with said first and second tubular portions of said compression fitting, and said dispensing portion having first and second viscoelastic liquid outlets disposed therein.

6. The viscoelastic liquid dispensing system in accordance with claim 1, further comprising a locking structure disposed on said flow splitter body and proximate to said first and said second tubular portions of said compression fitting, said locking structure adapted to securely attach said compression fitting to said double barreled liquid dispensing syringe.

7. The viscoelastic liquid dispensing system in accordance with claim 1, further comprising:

a first bore coupling coupled to said first outlet portion; and a second bore coupling coupled to said second outlet portion, wherein each coupling is configured to securely connect a tube to the flow splitter body.

8. The viscoelastic liquid dispensing system in accordance with claim 1, wherein rotation of said feed screw mixes a first viscoelastic component liquid and a second viscoelastic component to form a viscoelastic liquid product and rotation directly discharges a pre-selected amount of said product from a dispenser tip fluidically coupled to said chamber.

9. The viscoelastic liquid dispensing system in accordance with claim 8, further comprising a first and a second positive shutoff mechanism disposed on said at least one feed screw, said first and said second positive shutoff mechanisms each having a sealing shoulder configured to contact said first and second input channels, wherein said first and second positive shutoff mechanisms are configured to selectively close said first and said second input channels to viscoelastic fluid flow.

10. The viscoelastic liquid dispensing system in accordance with claim 8, further comprising a dispenser tip fluidically coupled to said feed screw chamber, wherein said at least one feed screw further comprises only one feed screw having a tapered shape having a smaller diameter proximate to said dispenser tip than distal to said dispenser tip.

11. The viscoelastic liquid dispensing system in accordance with claim 8, wherein said at least one feed screw further comprises said at least one feed screw having a variable pitch.

12. The viscoelastic liquid dispensing system in accordance with claim 8, wherein said at least one feed screw further comprises two feed screws disposed in said feed screw chamber, each of said two feed screws includes helical threads, wherein the helical threads are partially overlapping between the two feed screws.

13. The viscoelastic liquid dispensing system in accordance with claim 8, wherein said at least one feed screw further comprises two feed screws disposed in said feed screw chamber, wherein each of said two feed screws includes helical threads that are non-overlapping between the two feed screws.

14. The viscoelastic liquid dispensing system in accordance with claim 8, further comprising a dispenser body, wherein said feed screw chamber, and said first and said second input channels are formed therein.

15. The viscoelastic liquid dispensing system in accordance with claim 14, wherein said dispenser body further comprises a ceramic dispenser body.

16. The viscoelastic liquid dispensing system in accordance with claim 14, further comprising at least one heating element disposed on or within said dispenser body.

17. The viscoelastic liquid dispensing system in accordance with claim 8, further comprising at least one heating element disposed in said at least one feed screw.

18. A viscoelastic liquid dispensing system, comprising:

a double barreled viscoelastic liquid dispensing syringe;

a viscoelastic liquid flow splitter of one-piece construction fluidically coupled to the double barreled viscoelastic liquid dispensing syringe, the viscoelastic liquid flow splitter having:

a first splitter bore including a first splitter outlet portion, a first splitter inlet portion, and a first splitter intermediate portion extended between the first splitter outlet portion and the first splitter inlet portion, the first splitter outlet portion having a cylindrical length defined, in cross-section, by substantially parallel sidewalls extended between a first end communicated, at all times, with the first splitter inlet portion via the first splitter intermediate portion and a second end having a first splitter outlet opening, a second splitter bore including a second splitter outlet portion, a second splitter inlet portion, and a second splitter intermediate portion extended between the second splitter outlet portion and the second splitter inlet portion, the second splitter outlet portion having a cylindrical length defined, in cross-section, by substantially parallel sidewalls extended between a first end communicated, at all times, with the second splitter inlet portion via the second splitter intermediate portion and a second end having a second splitter outlet opening, wherein the first and second splitter inlet portions are substantially parallel to each other, wherein the first and second splitter intermediate portions are substantially parallel to each other, and wherein the first and second splitter outlet portions diverge from each other over the cylindrical lengths thereof from the first ends thereof to the first and second splitter outlet openings, and a compression fitting having first and second tubular portions fluidically coupled to the first and second splitter inlet portions, and an outer compression portion substantially coaxial with the first and second tubular portions, wherein the first and second tubular portions of the compression fitting are fluidically coupled to the double barreled viscoelastic liquid dispensing syringe; and a viscoelastic positive displacement apparatus fluidically coupled to the viscoelastic liquid flow splitter, the viscoelastic positive displacement apparatus having:

a feed screw chamber including a first input channel fluidically coupled to the first splitter outlet portion of the viscoelastic liquid flow splitter and a second input channel fluidically coupled to the second splitter outlet portion of the viscoelastic liquid flow splitter, and at least one feed screw disposed in the feed screw chamber, wherein rotation of the feed screw mixes a first viscoelastic component liquid and a second viscoelastic component to form a viscoelastic liquid product and directly discharges a pre-selected amount of the product from a dispenser tip fluidically coupled to the chamber.

* * * * *

UNITED STATES PATENT AND TRADEMARK OFFICE

CERTIFICATE OF CORRECTION

PATENT NO. : 8,070,018 B2
APPLICATION NO. : 11/394769
DATED : December 6, 2011
INVENTOR(S) : Timothy D. Strecker et al.

It is certified that error appears in the above-identified patent and that said Letters Patent is hereby corrected as shown below:

In column 10, line 30, in Claim 1, delete "contruction" and insert -- construction --, therefor.

Signed and Sealed this
Twenty-fifth Day of September, 2012

David J. Kappos

David J. Kappos
*Director of the United States Patent and Trademark Office*